United States Patent [19]

Seragnoli

[11] 4,444,209

[45] Apr. 24, 1984

[54] WEB GUIDE DEVICE

[75] Inventor: Enzo Seragnoli, Bologna, Italy

[73] Assignee: G.D Societa' per Azioni, Bologna, Italy

[21] Appl. No.: 357,183

[22] Filed: Mar. 11, 1982

[30] Foreign Application Priority Data

Apr. 10, 1981 [IT] Italy ..... 48248 A/81

[51] Int. Cl.[3] ..... A24C 5/14; A24C 5/20

[52] U.S. Cl. ..... 131/60; 131/84 R

[58] Field of Search ..... 131/66 A, 60, 66 R, 131/84 R, 84 A, 84 B, 84 C, 105

[56] References Cited

U.S. PATENT DOCUMENTS 1,115,828 11/1914 Johnston ..... 131/60

*Primary Examiner*—Vincent Millin

*Attorney, Agent, or Firm*—Merriam, Marshall & Bicknell

[57] ABSTRACT

A web guide device particularly adapted to be mounted on a cigarette-making machine, in which at least one web is automatically advanced along a substantially U-shaped path. The path includes first and second end parts joined by an intermediate curved section; at least the second part, disposed downstream of the said curved section in the direction of advancement of the web extends at least partially along a web transport device for conveying the said web material. A guide element, movable at the same speed and in the same direction as the conveyor device, defines in combination therewith, upstream of the second end part, a passage for the web material.

5 Claims, 3 Drawing Figures

Fig.1
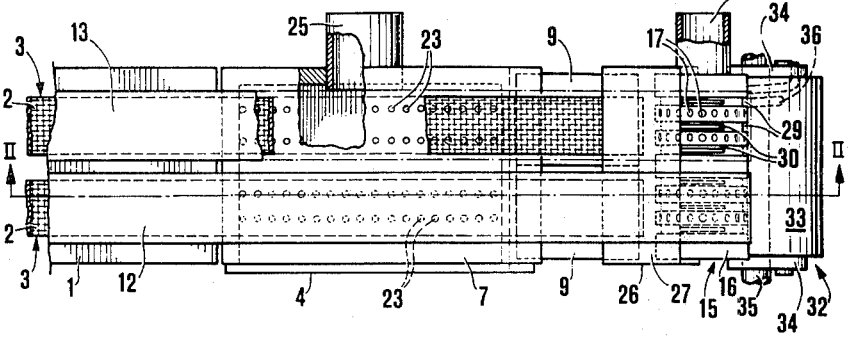
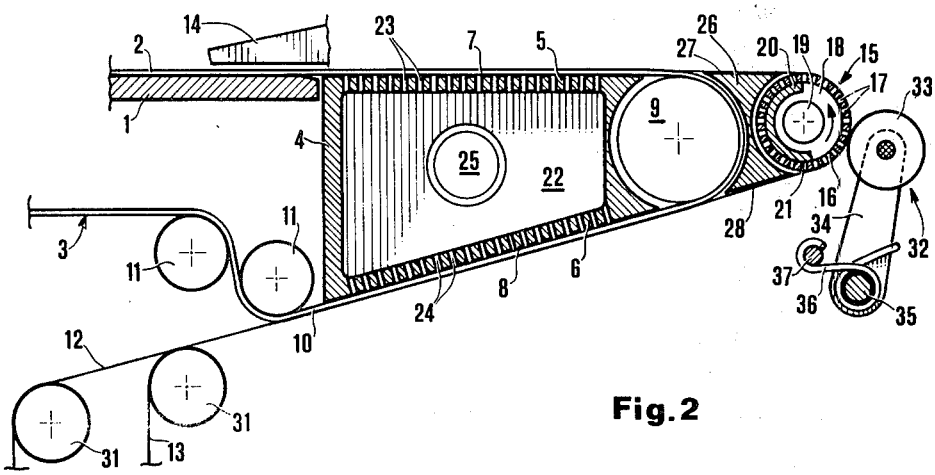
Fig.2
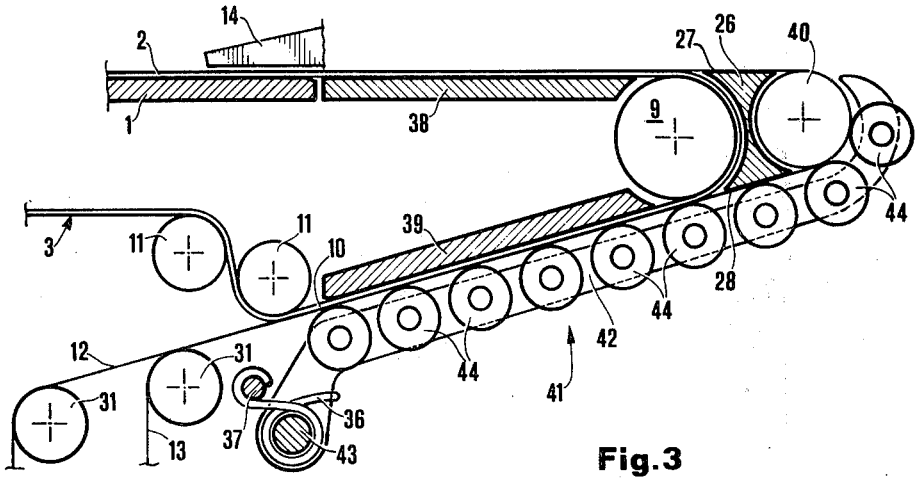
Fig.3

WEB GUIDE DEVICE

BACKGROUND OF THE INVENTION

The present invention relates to a web guide device operable to permit a web of material, particularly a paper web, to be wound about at least one return pulley.

Although in the following description reference will only be made to a cigarette-making machine, it is clear that the web guide device forming the subject of the present invention can be applied to any of those machines in which strip or web material, in particular paper, is made to advance along a non-rectilinear path to which it is difficult for an operator to gain access.

Cigarette-making machines normally include a supply unit within which a web of paper unwound from a reel is supplied through a plurality of operator units until it reaches a deflector pulley about which the strip is wound, following which it then proceeds horizontally over a bed along which the web is progressively folded transversely until it forms a continuous cylinder. Near to the said deflection pulley the section of the paper web which advances along the said bed receives a continuous layer of shredded tobaco which becomes enclosed within the said continuous cylinder in such a way as to form a continuous cigarette rod.

When, during the operation of the cigarette-making machine, the paper web breaks upstream of the said return pulley, a sensor normally provided along the path followed by the web automatically interrupts the operation of the cigarette-making machine thereby permitting an operator to intervene.

Among the various operations which this latter must perform to put the machine back into operation, one of the most complicated is certainly that consisting in rewinding the paper web about the said return pulley and then threading it through the normally narrow space between the said bed and the end of a conveyor which supplies the said layer of tobacco.

Such operation, which is difficult to perform on a cigarette-machine forming a single rod of cigarette, becomes almost impossible when it has to be performed on a twin rod cigarette making machine, that is to say one capable of simultaneously producing two rods of cigarette. In fact, in this machine, there are two paper webs and these have to be wound about respective return pulleys which are positioned coaxially to one another, before advancing along the bed on which the rods are formed.

Consequently, one of the said two return pulleys is completely obscured by the other as far as the operator who has to operate thereon is concerned, and therefore is substantially inaccessible. A known web guide device is described in Italian patent application No. 50484-A-79 filed in the name of the same Applicant, G.D.S.P.A, in which the winding of the web about the said pulley is performed in an automatic manner. In this device the said pulley and other fixed and movable elements located close to the pulley itself along the path provided for the web are hollow and are provided with holes in the region of contact with the web.

The interior of these members communicate with a vacuum source, and the web can be made to follow around the said pulley until it reaches the rod forming bed simply by making the end of it adhere to the first and therefore most accessible of the said movable suction members.

A device of the type described, although resolving the described problems in a quite satisfactory manner nevertheless is rather complicated and expensive to manufacture. Moreover, it has been established that this device, after a certain period of continuous operation of the cigarette-making machine, can become less efficient because of obstruction of some of the said suction holes.

These holes must, in fact, necessarily be made of extremely small dimensions so as not to cause deformation or damage to the web however, they can sometimes become obstructed, after long use, by dust or fragments of paper released from the web itself.

SUMMARY OF THE INVENTION

The object of the present invention is that of providing a highly reliable web guide device which will be able to permit the automatic winding of a web about a pulley without this operation requiring any manual intervention.

A particular object of the present invention is that of providing a web guide device of simple and economical type, which can be mounted on a cigarette-making machine, in particular a twin rod cigarette-making machine, to permit the automatic winding of at least one strip of paper about a respective deflection pulley disposed immediately upstream of at least one cigarette rod forming bed.

The said objects are achieved by the present invention in that it relates to a web guide device particularly for the automatic advancement of at least one web of paper along a substantially U-shaped path and includes a first and a second end part joined by an intermediate curved section, the said second part, disposed downstream of the said curved section in the direction of advancement of the web extending at least partially along a transporting conveyor device for each said web, characterised by the fact that it includes a guide element movable at the same speed and in the same direction as the said conveyor device, adjacent the said conveyor device itself upstream of the said second end part.

BRIEF DESCRIPTION OF THE DRAWINGS

Further characteristics and advantages of the present invention will become apparent from the following description with reference to the attached drawings, which illustrate several non limiting embodiments thereof, in which:

FIG. 1 is a plan view of a first embodiment of the web guide device according to the present invention;

FIG. 2 is a sectional view taken along the line II—II of the web guide device of FIG. 1; and FIG. 3 schematically illustrates, in section, a second embodiment of the web guide device according to the present invention.

DETAILED DESCRIPTION OF THE INVENTION

With reference to FIGS. 1 and 2, there is shown a rod forming bed 1 of a cigarette-making machine, of which only the input end is shown.

The bed 1 is fixed in a substantially horizontal position on a frame (not illustrated) of the cigarette-making machine, and slidably supports the upper branches 2 of two adjacent conveyor belts 3 which are made in such a way as to be air permeable.

At the input end of the bed 1 there is located a box 4 defined, above and below respectively, by two walls 5 and 6. The wall 5 defines an upper surface 7 coplanar with the upper face of the bed 1 whilst the wall 6, as seen in FIG. 2, is inclined upwardly from left to right and defines a lower surface indicated as 8. Near the end of the box 4 opposite the bed 1 the above mentioned frames support two adjacent pulleys 9 rotatable about a common horizontal axis.

About the pulleys 9 are wound the conveyor belts 3 so that each forms a continuous loop, the lower branch 10 of which runs beneath the bed 1 and around a pair of deflector pulleys 11 and the wall 6 of the box 4.

The upper branches 2 of the conveyor belts 3 are operable to produce advancement along the upper surface of the bed 1 of respective paper webs 12 and 13 over each of which there is supplied a layer of shredded tobacco (not illustrated) by means of a known supply device only the final end part of which, indicated as 14, is illustrated.

A pulley 15, constituted by a tube 16 having a plurality of uniformly distributed radial holes 17 is located in a horizontal position near to the pulleys 9 and on the opposite side of these latter with respect to the input end of the bed 1. The pulley 15 is rotatably supported by the frame (not illustrated) of the cigarette-making machine to turn, under the thrust of drive means (not illustrated), about a horizontal axis parallel to the axis of rotation of the pulleys 9.

The tube 16 defines a cylindrical chamber 18 communicating on one hand with the outside through holes 17 and on the inside with a suction device (not illustrated) having an input duct 19 which extends axially out from the chamber 18.

Within chamber 18, in a fixed position with respect to the said frame of the cigarette-making machine, is a screen or hole covering element 20 having a partly cylindrical surface 21 extending over an angle at least equal to 180°.

The surface 21 is located coaxially with respect to the pulley 15 and cooperates to form an airtight seal with at least that one of the two sides of the inner cylindrical surface of the tube 16 which faces the pulleys 9.

The box 4 has an interior chamber 22 defined above and below by the walls 5 and 6 respectively; these latter are provided with respective pluralities of uniformly distributed holes 23 and 24, and are disposed with the surfaces 7 and 8 respectively in contact with the branches 2 and 10 of the belts 3. The chamber 22 communicates, on the one hand, with the exterior through the holes 23 and 24, and on the other hand with the said suction device (not illustrated) a further intake duct 25 which extends axially out from a lateral wall of the box 4.

Between the pulleys 9 and 15 there is disposed a double-faced guide block 26 supported by the said frame, the two opposite sides of which closely follow the outline of the pulleys 9 and 15 themselves, and which is defined above and below by respective flat surfaces 27 and 28 coplanar with the said surfaces 7 and 8 respectively.

The pulley 15 has a plurality of external annular grooves 29 each of which is slidably engaged by a respective projection 30 extending in a horizontal direction from the guide block 26 towards the pulley 15 itself. As illustrated in FIG. 1, each of the two paper webs 12 and 13 is supplied from below to a respective deflector pulley 31 and, then, over the upper branch 2 of the respective conveyor belt 3 along a substantially U-shaped path. This latter includes a curved section extending in contact with part of the outer surface of the pulley 15 and joining together a first rectilinear section extending between the pulleys 11 and the pulley 15, and tangentially with respect to the branches 10 of the belts 3 and to the surface 28, and a second rectilinear section extending above and in contact with the guide block 26 and the upper surface of the branch 2 of the respective belt 3. In particular, the curved section of the said U-shaped path extends along that part of the periphery of the pulley 15 in which the holes 17 are not covered by the screen element 20 and are therefore in direct communication with the duct 19.

Close to the pulley 15 there is located a guide element generally indicated 32 which constitutes, in combination with the belts 3, the pulley 15 and the above mentioned suction means, the web guide device constituting the subject of the present invention. This guide element 32 includes a free roller 33 the axis of which is parallel to that of the pulley 15, and which is supported substantially in contact with it by two substantially vertical arms 34 rigidly connected at the bottom to a shaft 35. The shaft is parallel to the axis of the pulley 15 and is supported rotatably beneath it by the said frame. A helical spring 36 is wound about a part of the shaft 35 and is engaged at one end by one of the arms 34 and at the other by a pin 37 rigidly connected to the frame.

The roller 33 the peripheral surface of which is preferably made of rubber or other similar resilient material having a high coefficient of friction, is maintained pressed against the pulley 15 by the spring 36, but it can be pulled away from it at any time to perform cleaning operations or for any other reason.

In use, when the webs 12 and 13 must be wound over the pulley 15 and onto the bed 1, at the commencement of operations or else subsequently following a breakage of one or both of the webs 12 and 13 after operations have been started, the webs 12 and 13 are made to advance with a reduced speed until their free ends are disposed above the pulleys 31. At this point, by turning on the said suction device (not illustrated) it is possible to create a vacuum within the chambers 22 and 18 and, therefore, a flow of air through the holes 23 and 24 and through the holes 17 left free by the screen element 20. The strips 12 and 13 are therefore fed towards the pulley 15 by the belts 3 to which they adhere in correspondence with the wall 6 of the box 22.

Upon their arrival at the pulley 15 the ends of the webs 12 and 13 are drawn by suction onto the outer surface of pulley 15 and become positioned between the pulley 15 and the roller 33. This roller 33, thereby drawn into rotation by friction due to being substantially tangential with the pulley 15, cooperates with the belt 3 and with the said suction means to move the webs 12 and 13 securely towards the bed 1.

The ends of the webs 12 and 13 are consequently pushed over the guide block 26 and arrive first at the branches 2 of the belt 3, to which they adhere thanks to the suction applied through the holes 23 of the wall 5, and then the bed 1.

Naturally, once the webs 12 and 13 have reached bed 1 in the manner described the air suction by means of the ducts 19 and 25 can be stopped. It is to be noted that the fact of having positioned the said roller 33 close to the pulley 15 makes the web guide device 32 very reliable, and protects it against any sliding of the webs 12 and 13 with respect to the elements which convey them.

The roller 33, moreover, has been found to be able to operate in a satisfactory manner even without the described suction operated traction elements 19 and 25 instead of in combination with them.

Without use of suction the webs 12 and 13 must be manually introduced into the nip between the roller 33 and the pulley 15. Fixed or movable guide means (not shown) closely following a convenient section of the free surface of the webs 12 and 13 downstream of the said nip facilitate the correct transfer of the webs 12 and 13 towards the bed 1.

In a second embodiment of the device in question, illustrated in FIG. 3, two walls 38 and 39 are disposed in exactly the same positions as those occupied in the previously described embodiment by the walls 5 and 6 of the box 4. The said hollow perforated pulley 15 is replaced by a pulley 40 which does not have these characteristics. The guide element 32 is replaced by a guide element 41 comprising two arms 42 (only one of which is shown in FIG. 3) the length and form of which substantially follows that of the section of the path which the webs 12 and 13 must follow along the lower branches 10 of the belts 3 and about the pulley 40.

The arms 42, supported by a shaft 43 parallel to the axis of the pulley 40, together rotatably support a plurality of rollers 44 parallel to the said pulley 40 and regularly distributed along the arms 42 themselves, which closely follow in the lines of the successive sections of the belts 3 adjacent to the wall 39, the surface 28 of the guide block 26, and the pulley 40. Again, the peripheral surface of each of the rollers 44 is, like the roller 33, preferably made of rubber or other resilient material having a high coefficient of friction; it is moreover envisaged that the rollers 44 may be mounted on the arms 42 in a resilient manner which it has not been considered necessary to illustrate or describe since the precise nature of such mounting would be apparent to one skilled in the art.

The said fixed guide means can be constituted by the arms 42. In use, the device illustrated in FIG. 3 behaves in a very similar manner to that of the device previously described. Whilst the belts 3 advance at a reduced speed the edges of the webs 12 and 13 are made to pass around the respective pulleys 31 and are then inserted between the guide element 41 and the lower sections 10 of the belts 3. These webs 12 and 13 are then conveyed up to the pulley 40 thanks to the cooperation between the rollers 44 and the belts 3.

Naturally, the guide element 41 described could also operate in combination with the suction means previously described. From what has been said it will appear evident that when the guide elements 32 or 41 cooperate with the said suction means the reliability of the web guide device in question is significantly increased with respect to that of the known device previously described; in the other case examined, that is in the absence of the suction means, the device is more economical without its performance being considered to be appreciably inferior.

The web guide devices described, although discussed in relation to cigarette-making machines in which two strips of paper are advanced along the bed 1 for the simultaneous formation of two rods of cigarette, could be adapted for operation with a single strip of paper simply by reducing the axial dimensions of all the strip material transport and guide members.

Naturally, the principle of the invention remaining the same, numerous variations could be made to the device described purely by way of non limitative example without by this departing from the scope of the present invention. The plurality of rollers 44 of the guide element 41 can, for example, be surrounded, possibly with an associated reduction in the number of rollers 44, by one or more endless belts operable continuously and closely to follow the webs 12 and 13.

I claim:

1. A guide device for a web, particularly a paper web, the device comprising a belt conveyor for said web, said belt conveyor comprising a first pulley and a belt extending about said pulley, a first portion and a second portion of said belt extending upstream and downstream respectively from said first pulley in the direction of advancement of said web and respectively defining part of a path for first and second end sections of a U-shaped path for said web, said web having first and second end sections connected to one another by an intermediate curved section extending about a second pulley, and a web guide element in contact with the web and movable at the same speed and in the same direction as said web and arranged adjacent to said web path and upstream from said web second end section.

2. A device as claimed in claim 1, wherein said guide element comprises at least one roller, the axis of which is parallel to an axis of said web curved section, and the periphery of which is arranged in a tangential relationship with said curved section.

3. A device as claimed in claim 1, wherein said guide element comprises a plurality of rollers, the axes of which are parallel to an axis of said curved section and the periphery of each said roller is arranged in a tangential relationship with a respective portion of said web path extending upstream from said web second end section.

4. A device as claimed in claim 2 including resilient means to push said roller into said tangential relationship with said web path.

5. A device as claimed in claim 3 including resilient means to push said rollers into said tangential relationship with said web path.

* * * * *